US005922234A

United States Patent [19]

Grow et al.

[11] Patent Number: 5,922,234

[45] Date of Patent: Jul. 13, 1999

[54] SYSTEM APPARATUS AND METHOD FOR HEATING METAL PRODUCTS IN AN OSCILLATING INDUCTION FURNACE

[75] Inventors: Robert J. Grow, Sandy; W. Shane Swanger, Pleasant Grove, both of Utah

[73] Assignee: Geneva Steel, Provo, Utah

[21] Appl. No.: 08/855,014

[22] Filed: May 13, 1997

Related U.S. Application Data

[XX .

[60] Provisional application No. 60/022,187, Jul. 19, 1996.

[51] Int. Cl.[6] ..... H05B 6/10

[52] U.S. Cl. ..... 219/645; 219/614; 219/647; 219/653

[58] Field of Search ..... 219/608, 614, 219/619, 626, 635, 646, 647, 650, 653, 654, 655, 656, 645

[56] References Cited

U.S. PATENT DOCUMENTS

| | | | |
|---|---|---|---|
| 2,706,212 | 5/1955 | Rohn | 13/27 |
| 2,722,589 | 11/1955 | Marquardt | 219/10.61 |
| 2,811,623 | 10/1957 | Guthrie | 219/10.41 |
| 3,121,779 | 2/1964 | Eckel et al. | 219/10.67 |
| 3,471,673 | 10/1969 | Frostick | 219/10.69 |
| 3,717,740 | 2/1973 | Vickers | 219/10.57 |
| 4,075,450 | 2/1978 | Lavins, Jr. | 219/10.71 |
| 4,093,839 | 6/1978 | Moliterno et al. | 219/8.5 |
| 4,307,276 | 12/1981 | Kurata et al. | 219/10.41 |
| 4,315,124 | 2/1982 | Granstrom et al. | 219/10.71 |
| 4,352,969 | 10/1982 | Wulf | 219/10.75 |
| 5,433,800 | 7/1995 | Bishop | 148/510 |

FOREIGN PATENT DOCUMENTS

| | | |
|---|---|---|
| 2372402 | 6/1978 | France . |
| 63-183125 | 1/1988 | Japan . |
| 701338 | 12/1953 | United Kingdom . |

*Primary Examiner*—Tu B. Hoang
*Attorney, Agent, or Firm*—Madson & Metcalf

[57] ABSTRACT

Disclosed is a heating system for heating metal products in an oscillating induction furnace and a method of operation of the heating system. The heating system includes an oscillating induction furnace that in turn comprises a plurality of induction coils interspersed with a plurality of rollers. The metal products are oscillated within the induction coils on the plurality of rollers until heated to a target temperature. A logic device determines the power to be supplied to the induction coils, the number and speed of oscillation passes to conduct, the duration of time to be spent in the oscillating induction furnace, and the loading arrangement of the metal products within the oscillating induction furnace if two or more metal products are to be heated together in the oscillating induction furnace. The power supplied to the initial and final induction coils is metered by the logic device according to the proximity of the metal product to the initial and final induction coils. When heating a combination of metal products, each metal product can be separately loaded into and discharged from the oscillating induction furnace. Once the hottest of the metal products is brought to within a predetermined range from a target temperature, the oscillating induction furnace maintains the temperature of the metal products within the predetermined range until a downstream processing station signals that it is ready to receive a heated metal product, at which time the hottest of the metal products is discharged from the oscillating induction furnace.

35 Claims, 5 Drawing Sheets

SYSTEM APPARATUS AND METHOD FOR HEATING METAL PRODUCTS IN AN OSCILLATING INDUCTION FURNACE

This application claims benefit of provisional application 60/022,187 filed Jul. 19, 1996.

BACKGROUND OF THE INVENTION

1. The Field of the Invention

The present invention relates to systems, methods, and apparatus for heating metal products. More specifically, the present invention relates to oscillating induction furnaces and methods for heating metal products in an oscillating induction furnace.

2. The Relevant Technology

The production of steel and other metal products requires that the metal products be maintained at a certain temperature subsequent to the initial casting and refinement of the metal products from raw materials. As an example, iron is typically molten and cast into steel slabs in an initial procedure in the steel making process. These steel slabs must be later rolled or otherwise shaped into specified dimensions. In the interim between casting and rolling, however, the steel slabs cool off to a temperature below the optimum rolling temperature. To bring the steel slabs back up to the optimum rolling temperature, the steel slabs are heated in a furnace.

Several types of furnaces have been used for heating metal products. One type of furnace frequently used for heating and reheating metal products is the gas fire furnace. The gas fire furnace is, in its simplest form, a large gas oven in which the metal products are placed. The gas fire furnace is capable of heating metal products to a broad range of temperatures and is relatively cost efficient to operate. Nevertheless, the gas fire furnace has drawbacks in certain applications. For instance, the gas fire furnace generally has a low throughput, is expensive to construct, and occupies a large amount of space in the mill. Additionally, it is not always easy to predict the exact time when the rolling equipment or other downstream processing station will be ready to process the reheated metal product. Accordingly, gas fire furnaces require a holding area in which to maintain the metal products at a target temperature until they are needed. The holding area requires additional expense to construct and operate, consumes additional space in the steel mill, and uses additional energy to operate.

Consequently, in applications where capital and space are limited and where a high throughput is required, the prior art has looked to less expensive, more compact furnaces. One such type of furnace is known as the induction furnace. The induction furnace typically comprises a large inductor coil to which is applied an alternating current of great magnitude and through which the metal product is passed. The induction furnace operates on the principle of resistive heating. That is, when a metal product is passed through the induction furnace, the inductor coil causes magnetic flux of varying magnitude and direction to pass through the metal product. The changing magnetic flux induces current in the metal product which encounters internal electrical resistance. The current, in overcoming the internal electrical resistance, generates heat according to the equation: $P=I^2R$, where I is the amount of current induced within the metal product and R is the internal electrical resistance of the metal product. The variable P represents the power expended and is proportional to the amount of heat generated within the metal product.

Induction furnaces also have their limitations, one of which is that different segments of the metal products are often heated at differing rates and thus attain divergent temperatures. The differing rates of heating are attributable to the configuration of the induction furnace in which the separate windings of the induction coil are typically spaced several inches apart from each other. Also, unless a very long inductor coil or series of inductor coils is used, the metal product must be left within the inductor coil for an extended period of time. Thus, portions of the metal products which are in closer proximity to the individual windings of the inductor coils receive greater amounts of magnetic flux than those portions in lesser proximity thereto. Consequently, a correspondingly greater current is induced within the portions in closer proximity to the windings, and these portions therefore attain a higher temperature than the portions in lesser proximity to the windings, resulting in adjacent segments of the metal product being nonuniformly heated to temperatures that vary greatly. This nonuniform heating of adjacent segments is known as temperature striping.

To rectify temperature striping, the prior art has attempted to oscillate the metal product back and forth within a vertically oriented inductor coil. Oscillation of the metal product also raises problems, however. For instance, when oscillating the metal product, the metal product is typically placed on a hydraulic ram which raises the metal product up and down within the inductor coil. The metal product must be moved onto and off of the hydraulic ram, which consumes processing time and reduces throughput. Also, the sizes of the metal products which can be raised on hydraulic rams are also limited, typically to under about 10 tons per slab in prior art induction furnaces. Furthermore, only a single metal product can be heated in such an induction furnace at a single time, and provision must be made for maintaining a target temperature of the heated metal slabs within the induction furnace once the heated metal slabs reach the target temperature and until the mill is ready for the heated metal slabs. Thus, a separate holding area is also generally required, causing the drawbacks discussed above in regards to a holding area.

As an additional limitation of prior art oscillating induction furnaces, typically only a single metal product can be passed through a prior art oscillating induction furnace at any one time. Throughput of the prior art induction furnaces is therefore limited.

Accordingly, a need exists in the art for an induction furnace which overcomes the above-discussed problems. Specifically, an induction furnace is needed which does not incur significant temperature striping, which occupies minimal space within a steel mill, and which has a high throughput. Such an induction furnace is also needed which can maintain the metal products at a target temperature until the metal products are needed, which can heat metal products of great weight, and which can heat combinations of metal products concurrently.

OBJECTS AND BRIEF SUMMARY OF THE INVENTION

The system, apparatus, and method of the present invention have been developed in response to the present state of the art, and in particular, in response to the problems and needs in the art that have not yet been fully solved by currently available metal product heating furnaces. Thus, it is an overall objective of the present invention to provide an oscillating induction furnace that is capable of oscillating a metal product therein so as to avoid significant temperature striping of the metal product.

Another important object of the present invention is to provide such an oscillating induction furnace that does not occupy an inordinate amount of space in a mill.

A further object of the present invention is to provide an oscillating induction furnace and method of operation thereof which can heat metal products of greater dimensions and greater weight than prior art induction furnaces are capable of heating.

Yet another object of the present invention is to provide an oscillating induction furnace and method of operation thereof that can heat combinations of metal products simultaneously.

An additional object of the present invention is to provide such an oscillating induction furnace and method of operation thereof which can heat combinations of metal products with varying loading arrangements of the combination of metal products within the oscillating induction furnace.

A further object of the present invention is to provide a method of heating metal products with an oscillating induction furnace that is automated and can uniformly heat a series of metal products which vary in size or other characteristics to a specified target temperature.

Still another object of the present invention is to provide an oscillating induction furnace and method of operation thereof which can heat a combination of metal products and then maintain the heated metal products at a target temperature until a downstream processing station is ready for the heated metal products.

To achieve the foregoing objects, and in accordance with the invention as embodied and broadly described herein in the preferred embodiment, an improved heating system including an oscillating induction furnace and a method for heating metal products with the heating system are provided.

The heating system of the present invention comprises a charging table, an oscillating induction furnace, a discharging table, and a logic device for automatically operating the aforesaid components.

The oscillating induction furnace comprises a plurality of parallel rollers on which the metal products are transported. The plurality of parallel rollers are mounted horizontally on a plane within the induction furnace and are oriented transverse to the direction of travel of the metal products.

The rollers carry the metal products through a plurality of discrete induction coils that are energized with alternating electrical current. The alternating current pulsing through the induction coils generates a constantly reversing magnetic flux which passes through the metal products and induces therein a current of a constantly changing direction. The induced current encounters internal electrical resistance and consequently generates heat within the metal product. The metal product is thereby heated to a selected temperature as the metal product is transported through the plurality of induction coils on the plurality of rollers.

In one embodiment, each induction coil of the plurality of induction coils comprises a plurality of windings and is energized by a separate power supply. The induction coils are also discretely spaced apart from others of the plurality of induction coils by a minimum distance of about one foot, and the plurality of induction coils are each separated from others of the plurality of induction coils by at least one of the plurality of rollers.

In order to avoid temperature striping, the metal products are oscillated with an alternately progressive and regressive motion within the induction furnace. The metal products are automatically oscillated, loaded, and discharged from the induction furnace with the use of a logic device. In one embodiment, the logic device comprises a microprocessor.

The method of heating metal products of the present invention initially comprises programming certain information into the logic device. The information to be provided includes the parameters of target temperature, the maximum oscillating speed, the approximate time the metal products are to remain in the oscillating induction furnace, and the dimensions of the metal products to be heated. Once the logic device receives the information, it automatically determines the maximum amount of power to be supplied to the plurality of induction coils, the number of alternatingly progressive and regressive repetitions to be conducted, the speed with which each of the alternatingly progressive and regressive repetitions is to be conducted, and the loading arrangement of the metal products within the induction furnace, if a combination of metal products is to be heated together.

Thereafter, the metal product is loaded into the oscillation induction furnace from the charging table. Once loaded, the metal product is passed on the plurality of rollers through the plurality of induction coils. In order to avoid temperature striping, the metal product is propelled with an oscillating motion of alternatingly progressive and regressive repetitions. Preferably, each of the plurality of alternatingly progressive and regressive repetitions moves the metal product a distance of at least six inches in one direction.

During the oscillating of the metal product within the induction coils, the logic device automatically meters the amount of power that is supplied to the initial and final induction coils separately from the middle induction coils and responsive to the proximity of the metal product to the initial and final induction coils.

The logic device, with the use of a temperature sensor, monitors the temperature of the metal product and determines when the metal product is at or within a predetermined range from a target temperature. The logic device then adjusts the amount of power to be provided to the induction coils so as to maintain the temperature of the metal product at the target temperature or within the predetermined temperature range. The metal product is then continually oscillated at the adjusted power until the mill is ready to process the metal product.

When signaled that the mill is ready to process a heated metal product, a final pass is conducted. The metal product is then discharged onto the discharging table and transported to the next station for further processing. Another metal product is then loaded if required and the process repeats itself.

In one embodiment, the rollers are split into halves and configured with a motor on each side. Thus, the two halves of the rollers can operate independently. Consequently, combinations of metal products can be loaded within the oscillating induction furnace and individually brought to a target temperature. For instance, two metal products can be loaded side by side and brought separately or together to a target temperature. Metal products can also be loaded head to tail. The power supplied to the induction coils is adjusted to hold the hottest metal slab at the target temperature until it is needed by the mill. When the mill is ready for a metal slab, the hottest metal slab is discharged and another metal slab is loaded in its place.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
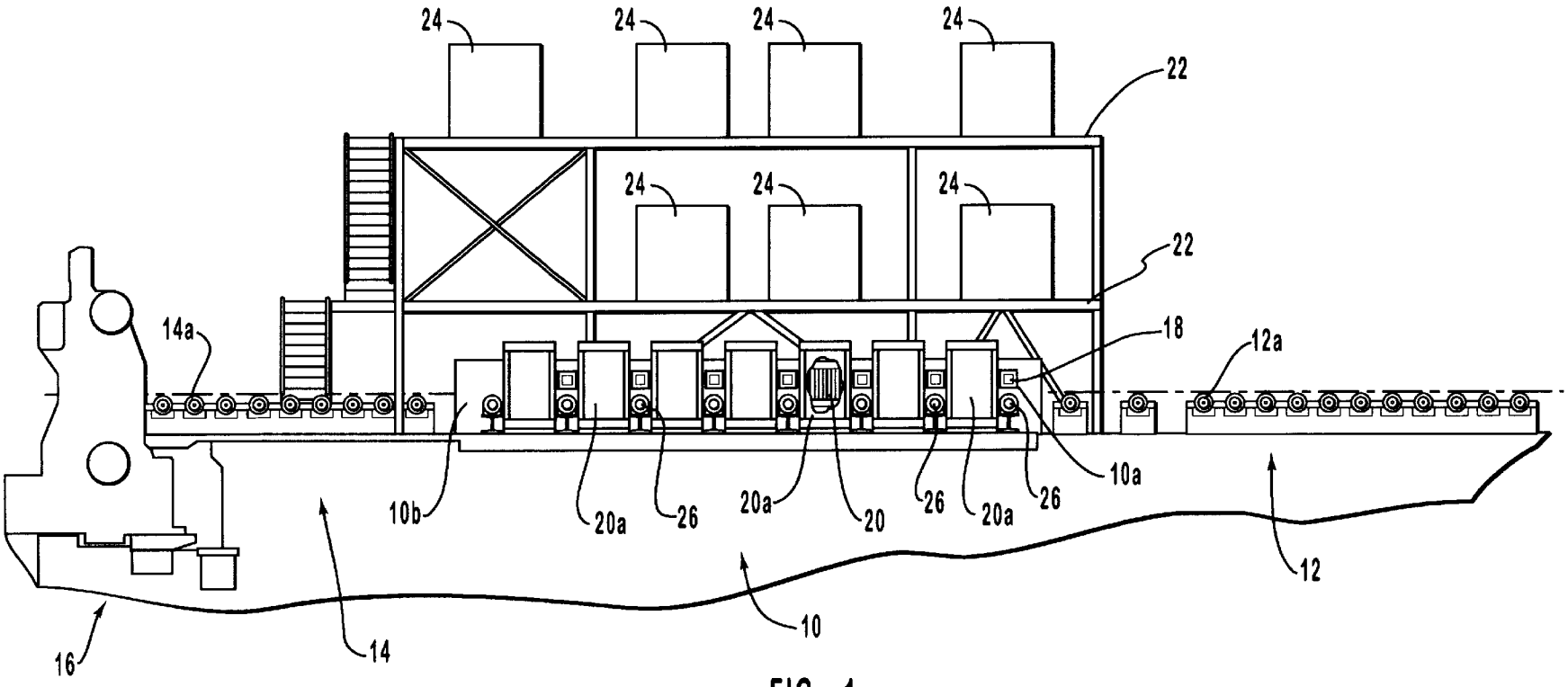
FIG. 1 is a side view of a heating system for heating metal products of the present invention showing an oscillating induction furnace, a charging table, a discharging table, and a downstream processing station.

FIG. 1 is a side view illustrating a heating system of the present invention. The heating system includes an oscillating induction furnace 10, a charging table 12, and a discharging table 14. A downstream processing station 16 also is partially shown. Charging table 12 is used to load a series of metal slabs 18 into a near end 10*a* of oscillating induction furnace 10 and is comprised of a plurality of parallel rollers 13 on which metal slabs 18 are transported into oscillating induction furnace 10. In one embodiment, metal slabs 18 comprise steel slabs.

Oscillating induction furnace 10 comprises a plurality of induction coils 20 located within housings 21. In the depicted embodiment, seven induction coils 20 are included, one of which is shown in break-away view within one of housings 21. In the depicted embodiment, one of a bank of power supplies 24 is used to energize each of induction coils 20. Of course, a single power supply 24 could energize more than one of induction coils 20. Also in the depicted embodiment, power supplies 24 are shown located on platforms 22 above oscillating induction furnace 10.

A plurality of parallel rollers 26 are mounted on a plane within induction furnace 10 and are oriented transverse to the direction of travel of metal slabs 18. In the depicted embodiment, eight rollers 26 are provided and are interspersed with the seven induction coils 20. Specifically, in the depicted embodiment, the placement of rollers 26 is alternated with the placement of induction coils 20, such that each of induction coils 20 is separated from others of induction coils by one of rollers 26. It will be appreciated that the number of rollers 26 and induction coils 20 can vary depending on the space available in the mill, and the capacity and throughput requirements of the induction furnace.

Discharging table 14 is located at a far end 10*b* of oscillating induction furnace 10 and transfers metal slabs 18 to downstream processing station 16 once metal slabs 18 are heated to a target temperature. In the depicted embodiment, metal slabs 18 are being heated from a starting temperature of about 2,000° F. to a target temperature of about 2,300° F. Discharging table 14 is comprised of a plurality of parallel rollers 14 *a* on which metal slabs 18 are transported from oscillating induction furnace 10 to downstream processing station 16. Metal slabs 18 are subjected to a further processing step such as rolling at downstream processing station 16.

Figure 2:
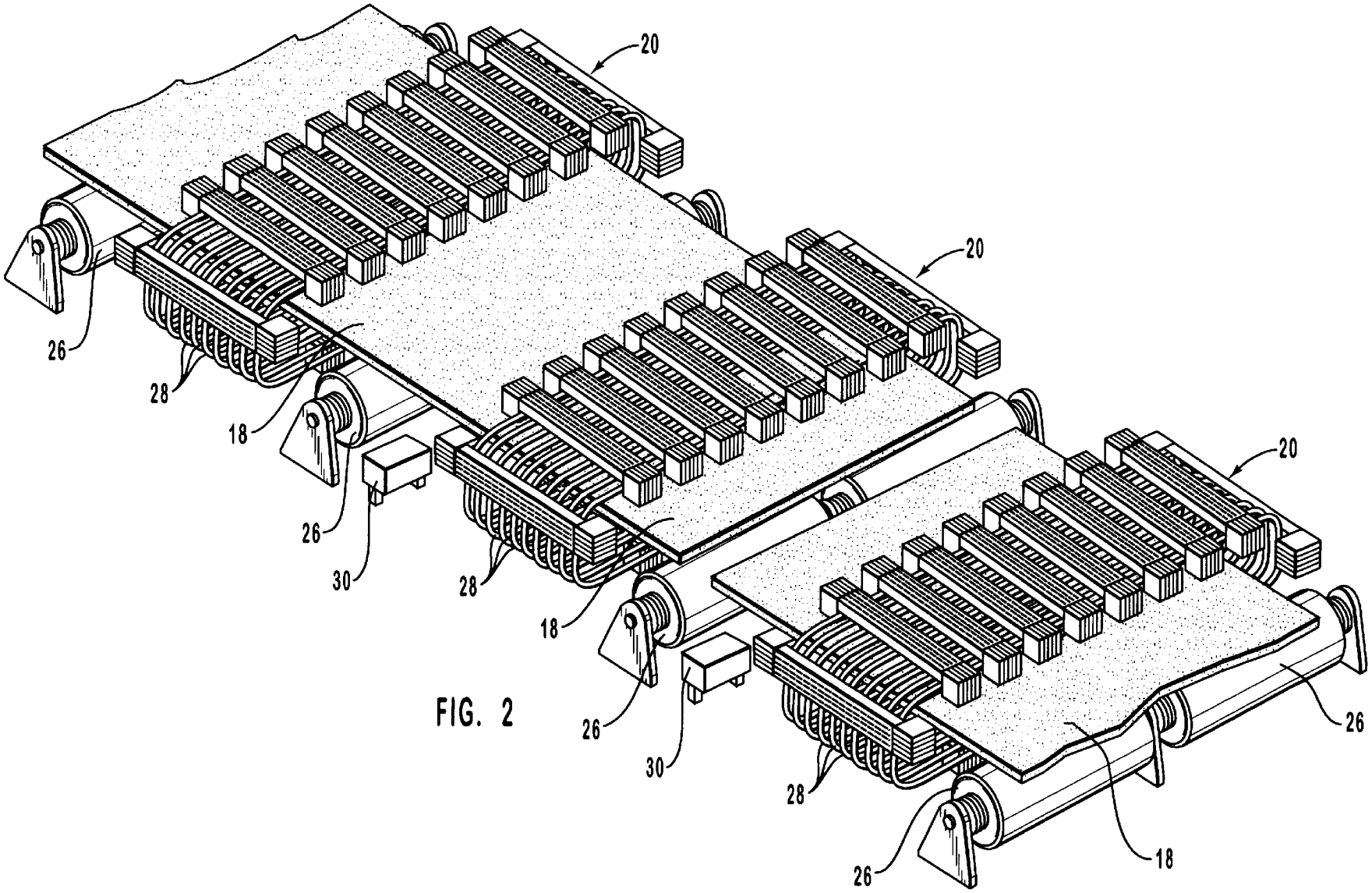
FIG. 2 is a partial perspective view of the oscillating induction furnace of the present invention showing three induction coils therein interspersed with four rollers.

FIG. 2 is a partial perspective view showing oscillating induction furnace 10 in greater detail. Housings 21 are omitted in order to better view induction coils 20. As shown in FIG. 2, each of induction coils 20 comprises a plurality of windings 28. In the depicted embodiment, windings 28 comprise hollow copper tubing through which a coolant fluid such as water is passed. When metal slab 18 is loaded in position within induction coils 20, a voltage generated by power supplies 24 is applied to each of induction coils 20. The voltage continually reverses in polarity, generating an alternating current within each of induction coils 20. In one embodiment, the power supplied to induction coils 20 is about 6000 Watts. As discussed above, magnetic flux resulting from the alternating current passes through metal slab 18, inducing the flow of electrical current within metal slab 18. The induced current overcomes internal electrical resistance of metal slab 18, resulting in the generation of heat in metal slab 18, and a resultant increase in surface temperature of metal slab 18. Prolonged exposure for a sufficient amount of time to the induced current allows the core of metal slab 18 to approach a temperature close to the surface temperature of metal slab 18.

Temperature sensor 30 is used to monitor the temperature of metal slab 18 in order to determine when metal slab 18 has reached a predetermined temperature such that metal slab 18 is ready for further processing and can be unloaded onto discharging table 14 of FIG. 1.

The use of rollers 16 to transport metal slab 18 through induction coils 20 provides several advantages. As one advantage, metal slab 18 can be of a greater size than can be processed by prior art vertical induction furnaces. In one preferred embodiment metal slabs 18 weigh over 10 tons. In a further embodiment, metal slabs weigh over 25 tons, and in yet another embodiment, metal slabs 18 weigh over 50 tons. Additionally, as also seen in FIG. 2, more than one metal slab can be heated within oscillating induction furnace 10 at one time. In FIG. 2, two metal slabs 18 are being heated in a head to tail loading arrangement. A further loading arrangement is shown in to FIG. 3, where four metal slabs 18 are being heated at once.

Figure 3:
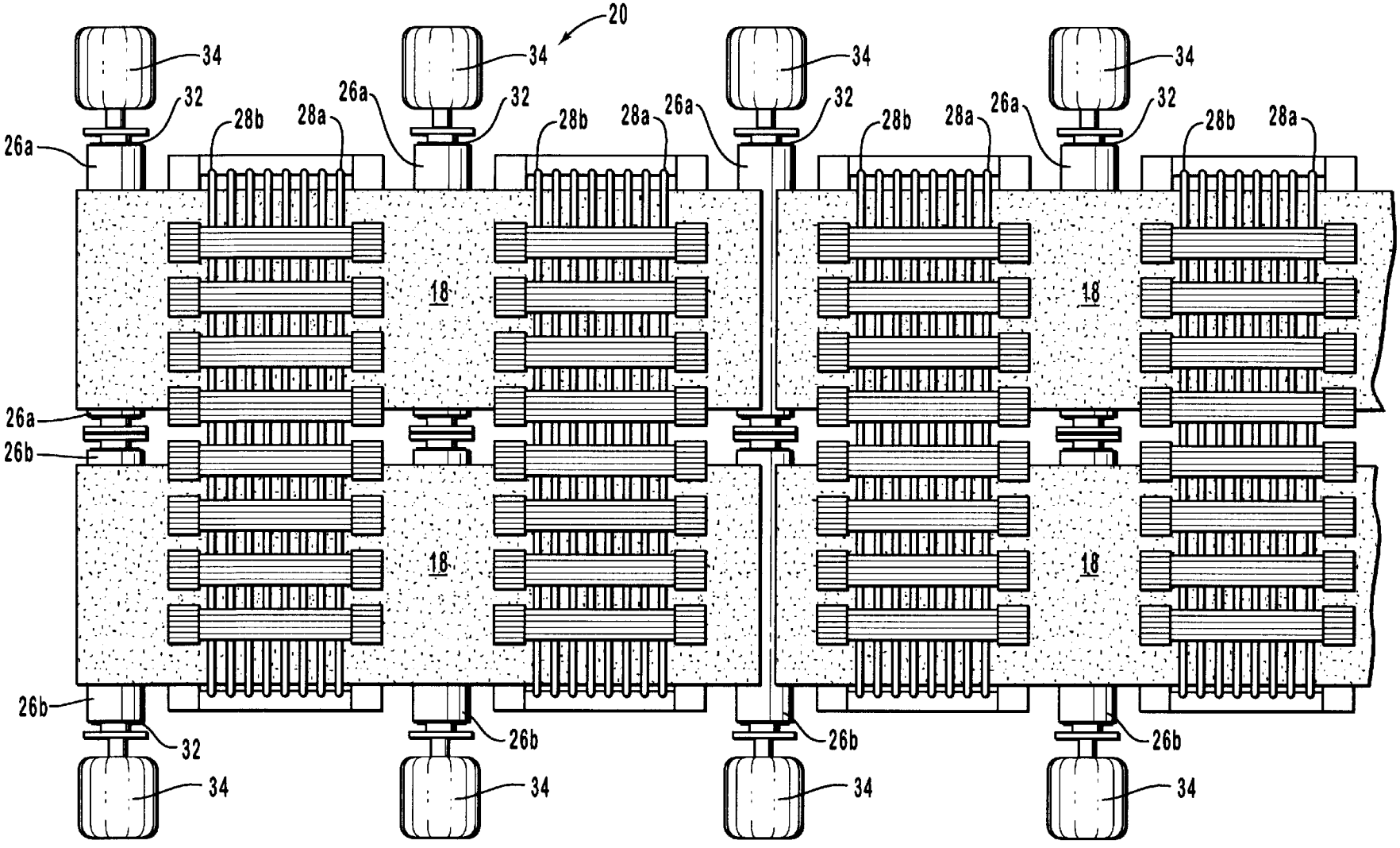
FIG. 3 is a partial top view illustrating the oscillating induction furnace of the present invention accommodating therein a combination of four metal slabs in one representative loading arrangement.

Referring now to FIG. 3, it can be seen that rollers 26 are each split into two sections 26*a* and 26*b*, each of which is provided with a separate set of bearings 32 and a motor 34. Motors 34 are controlled and synchronized with the use of a logic device, the operation of which will be discussed below.

Combinations of two or more metal slabs 18 can be heated in oscillating induction furnace 10 at one time, and two or more metal slabs 18 can be loaded side by side, one on each of sections 26*a* and 26*b*. Two or more metal slabs 18 can also be loaded head to tail on rollers 26 and heated concurrently, and three or more metal slabs 18 can be loaded in a loading arrangement of side by side and head to tail. Metal slabs 18 can be loaded and discharged independently of the others, even when placed side by side. Thus, a combination of metal slabs 18 can be progressively heated within induction furnace 10, with the earlier charged metal slabs 18 arriving at a higher temperature earlier and being discharged first.

In the depicted embodiment, each winding 28 of each induction coil 20 has an oval cross-section with a preferred dimension of 1⅞ inch×3⅜ inch and are spaced a distance apart. In the depicted embodiment, this distance is about ¾ of an inch. Of course, one skilled in the art will recognize that these dimensions are only representative, and can be altered for the particular application.

Each of induction coils 20 is discretely spaced a distance apart from the other induction coils 20. Preferably, induction coils 20 are spaced at least about one foot apart. In the depicted embodiment, each of induction coils 20 is spaced 67½ inches from each other. Once again, one skilled in the art will appreciate that the distance with which induction coils are spaced is a function of the amount of space in the mill, the number of induction coils 20 to be employed, and the rapidity with which metal slabs 18 are to be heated.

In order to avoid substantial temperature striping due to the distance between windings 24 and induction coils 20, metal slabs 18 are oscillated continually back and forth in an alternatingly progressive and regressive motion. Such a motion is depicted in FIG. 4, which is a diagram indicating the motion with which metal slabs 18 are moved.

Figure 4:
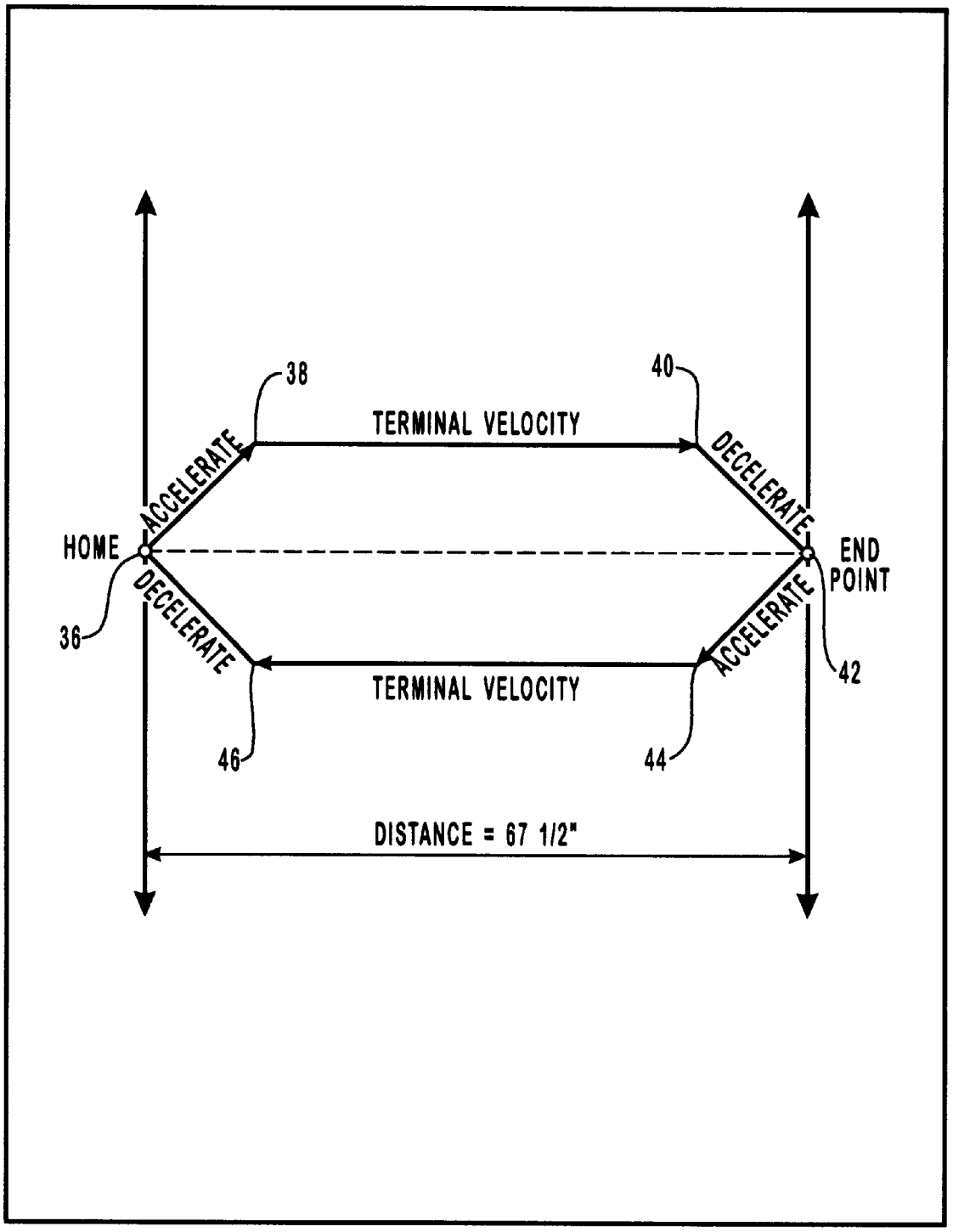
FIG. 4 is a motion diagram illustrating the oscillating movement of metal slabs within the oscillating induction furnace of the present invention.

Initially, as shown in FIG. 4, one or more metal slabs 18 are fed partially into induction furnace 10 to a position indicated as "HOME" 36, and are thereafter caused to accelerate in a forward motion. Thereafter, once achieving a terminal velocity at a position indicated at 38, metal slabs 18 continue to move forward until they arrive at the position indicated at 40, where metal slabs 18 are caused to decelerate until they reach zero velocity at the position indicated as "END POINT" 42. It is preferred that the HOME position be located at the leading edge of the initial induction coil 20*a* and that the HOME position be separated from the END POINT position by approximately the distance between induction coils 20. Consequently, in the depicted embodiment, the distance moved between the HOME position and the END POINT position is about 67½ inches.

After reaching the position indicated as END POINT 42, metal slabs 18 are caused to accelerate until reaching a terminal velocity at a position indicated at 44. Metal slabs 18 begin decelerating again at a position indicated at 46 until they reach zero velocity as the return to the position indicated as HOME 36. The process is repeated until the hottest of metal slabs 18 is sufficiently heated and downstream processing station 16 is ready to receive a heated metal slab 18.

The control of the heating system of the present invention is automated in one embodiment with a logic device. In the depicted embodiment, the logic device comprises a microprocessor 17.

Figure 5:
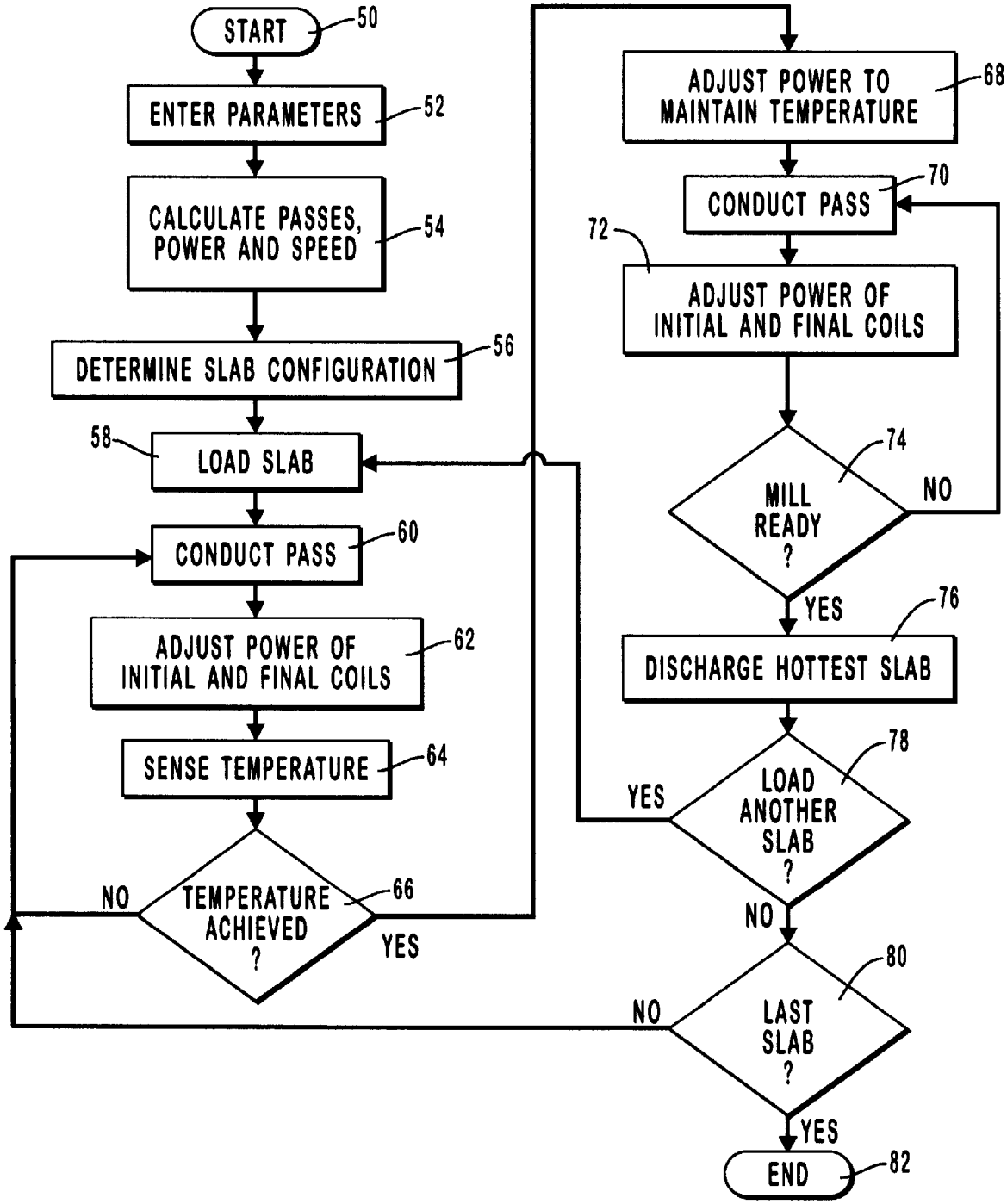
FIG. 5 is a flow diagram illustrating one manner of automated operation of the oscillating induction furnace of the present invention.

One method of operation of the heating system of the present invention is illustrated in the flow diagram of FIG. 5. As shown therein, initial power up of the heating system is represented in FIG. 5 by the functional block indicated as "START" 50. After power up, the heating system receives certain information from the operator or upstream processing stations, as indicated by the functional block labeled "ENTER PARAMETERS." This information includes the target temperature to which metal slab 18 is desired to be heated, the appropriate amount of time metal slab 18 is intended to remain in oscillating induction furnace 10, the size of metal slab 18, and the number metal slabs 18 to be heated at once, if a combination of more than one metal slab 18 is to be heated concurrently in induction furnace 10.

Once the parameters are entered, the logic device will calculate certain operating conditions, as represented by functional blocks 54 and 56. These operating conditions include the number of oscillation passes metal slabs 18 will undergo, the power to be supplied to induction coils 20, the speed with which the oscillation passes are conducted, and the loading arrangement of metal slabs 18. Thus, for instance, if a thicker metal slab 18 is to be heated, or if the metal slab 18 is to be heated in a shorter period of time, the logic device causes more power to be supplied to induction coils 20. Conversely, for smaller slabs or longer periods of time, the logic device causes less power to be supplied to induction coils 20. If a combination of two or more metal slabs 18 is to be heated at once, the logic device determines whether to load the combination of metal slabs 18 side by side, head to tail, or in a loading arrangement including side by side and head to tail.

Once the operating conditions are established, metal slabs 18 are loaded into induction furnace 20 through charging table 12 as indicated by functional block 58. Thereafter, an initial repetition of alternately progressive and regressive motions, referred to as a "pass," is conducted as indicated by functional block 60. During the initial pass and during each pass thereafter, as indicated by functional block 62, the power supplied to an initial induction coil 20*a* and a final induction coil 20*b*, shown in FIG. 3, is adjusted to compensate for loading effects. For instance, when metal slabs 18 are in lesser proximity to one of initial and final induction coils 20*a* and 20*b*, less power is supplied thereto, and when metal slabs 18 are in greater proximity to one of initial and final induction coils 20*a* and 20*b*, more power is supplied thereto. Current is thus uniformly induced in metal slabs 18, and metal slabs 18 are thereby uniformly heated.

Toward the end of each pass, the temperature of each of metal slabs 18 is sensed with temperature sensor 30 of FIG. 2 as indicated by functional block 64. Thereafter, as indicated by decision box 66, the temperature of the hottest of metal slabs 18 is compared with the target temperature. If the temperature of the hottest of metal slabs 18 is not at the target temperature or within a predetermined range from the target temperature, the decision indicated by "NO" is reached, the process branches back to the "CONDUCT PASS" functional block 60, and another pass is conducted in the manner discussed. If the present temperature is equal to or greater than the target temperature, the decision indicated by "YES" is reached and the process progresses to functional block 68. As indicated, the power supplied to induction coils 20 is then adjusted to a value that will ensure that further passes through the oscillating induction furnace do not cause metal slabs 18 to exceed the target temperature. A further pass through induction furnace 10 is then conducted as indicated by functional box 70, during which time the power of initial and final coils 20*a* and 20*b* is again adjusted, as indicated in functional block 27, in the manner discussed above.

After each pass at the adjusted temperature, as indicated by decision box 74, the logic device either queries the downstream processing equipment or waits for an operator input indicating whether downstream processing station 16 is ready for a heated metal slab. If downstream processing station 16 is not ready, the "NO" decision is reached, and the process branches to the "CONDUCT PASS" functional block 70. If downstream processing station 16 is ready, the "YES" decision is reached, and the process branches on to the functional box designated "DISCHARGE HOTTEST SLAB" 76. The hottest of metal slabs 18 should be within a predetermined range from the target temperature, typically about 20 degrees. If not, the logic device increases the power supplied to induction coils 20 in an appropriate amount to bring the hottest of metal slabs 18 to within the predetermined range from the target temperature on the final pass. Thereafter, as denoted by the functional box designated "DISCHARGE HOTTEST SLAB" 76, the hottest slab is discharged onto discharging table 14 and progresses to downstream processing station 16.

The logic device then queries an upstream processing station or an operator, as indicated by decision box 78, whether another metal slab 18 is available. If so, the process branches back to the "LOAD SLAB" functional block 58. If another metal slab is not available, the process branches along the "NO" decision path to a further decision box 80, where the logic device checks to see if all metal slabs have been discharged. If not, the process branches back along the "NO" decision path to the functional block designated as "CONDUCT PASS" 60 and continues to heat the slabs contained within induction furnace 10. If the last of metal slabs 18 has been discharged, the process takes the "YES" decision path to the functional block designated "END" 82, and the process ends.

The operator can manually override the automated system at any time. For instance, in some instances, it may be desired to pass a metal slab 18 through induction furnace 10 without heating the metal slab 18.

As stated, the heating process of the present invention can be conducted to heat a single metal slab or to heat combinations of multiple metal slabs at once. Thus, the metal slabs can be arranged head to tail or side by side or in a combination of head to tail and side by side. When the mill is ready to process one of the metal slabs, the logic device is notified, and proper amounts of power is supplied to bring the hottest of the metal slabs to the desired temperature. The hottest of the metal slabs is then discharged and another metal slab is loaded. In this manner, a combination of metal slabs of different temperatures are progressively heated in and independently discharged from induction furnace.

Due to the horizontal configuration of the oscillating induction furnace and to the use of the rollers interspersed between the induction coils of the present invention, metal slabs or other metal products of great weight can be heated with the induction furnace. Multiple metal slabs can be independently loaded and discharged, concurrently heated, and held at a constant temperature until the hottest of the metal slabs is needed by a downstream processing station. Additionally, due to the alternatingly progressive and regressive motion of the induction furnace of the present invention, temperature striping is substantially eliminated. Furthermore, the induction furnace of the present invention occupies a minimum of space, less than the gas fire furnaces of the prior art, and less than non-oscillating induction furnaces. The oscillating induction furnace of the present invention also provides great flexibility in the differing loading arrangements of metal slabs that can be heated therein at a single time.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A method for heating a metal product, comprising:

a. providing a plurality of horizontally oriented rollers on which to transport the metal product;

b. providing a plurality of induction coils energized with alternating electrical current with which to heat the metal product to a selected temperature as the metal product is transported through the plurality of induction coils on the plurality of rollers;

c. passing the metal product on the plurality of rollers through the plurality of induction coils with an alternately progressive and regressive motion so as to increase the temperature of the metal product;

d. sensing the arrival of the temperature of the metal product at the selected temperature: and e. adjusting the amount of the alternating current supplied to the plurality of induction coils in order to maintain the metal product within a specified temperature range from the selected temperature.

2. A method as recited in claim 1, wherein the plurality of induction coils and the plurality of rollers are interspersed.

3. A method as recited in claim 2, wherein each induction coil of the plurality of induction coils is separated from others of the plurality of induction coils by at least one of the plurality of rollers.

4. A method as recited in claim 1, wherein each of the plurality of induction as coils is comprised of a plurality of windings, is energized by a separate power supply, and is spaced apart from others of the plurality of induction coils by a distance of at least about one foot.

5. A method as recited in claim 1, wherein the metal product comprises a first metal slab, and wherein the method further comprises passing a second metal slab through the plurality of induction coils on the plurality of rollers concurrently with passing the first metal slab through the plurality of induction coils, a head portion of the second metal slab being passed through the plurality of induction coils adjacent to a tail portion of the first metal slab.

6. A method as recited in claim 1, wherein the metal product comprises a first metal slab, and wherein the method further comprises passing a second metal slab through the plurality of induction coils on the plurality of rollers side by side with the first metal slab.

7. A method as recited in claim 6, wherein each of the plurality of rollers comprises two sections, each section being capable of moving independently of the other section.

8. A method as recited in claim 7, further comprising loading the first metal slab onto a first section and loading the second metal slab onto a second section and discharging one of the first and second metal slabs prior to discharging the other of the first and second metal slabs.

9. A method as recited in claim 1, wherein the alternately progressive and regressive motion comprises a plurality of repetitions, each repetition moving the metal product a distance substantially corresponding to a distance separating the induction coils from each other.

10. A method as recited in claim 1, further comprising automatically determining with a logic device the amount of power to be supplied to the plurality of induction coils in response to a set of predetermined parameters.

11. A method as recited in claim 1, further comprising automatically determining with a logic device a number of repetitions of the alternately progressive and regressive motion to be conducted and the speed with which each repetition is conducted in response to a set of predetermined parameters.

12. A method as recited in claim 1, wherein the plurality of induction coils comprises an initial induction coil, a final induction coil, and at least one middle induction coil, and further comprising continuously supplying differing amounts of power through at least one of the initial and final induction coils, the amount of power supplied to the at least one of the initial and final induction coils being metered separately from the amount of power supplied to the at least one middle induction coil.

13. A method as recited in claim 12, wherein the amount of power transmitted through the initial and final induction coils is metered with a logic device during the alternately progressive and regressive motion in accordance with the proximity of the metal slab to the at least one of the initial and final induction coils.

14. A method as recited in claim 1, wherein the metal product comprises a first metal slab of a first temperature, and wherein the method further comprises passing a second metal slab with a second temperature substantially different from the first temperature through the plurality of induction coils on the plurality of rollers concurrently with passing the first metal slab through the plurality of induction coils.

15. A method as recited in claim 14, further comprising:

a. receiving an instruction to discharge the metal product;

b. sensing the temperature of the metal product;

c. adjusting the amount of the alternating current supplied to the plurality of induction coils in order to heat the metal product to a target temperature with a single repetition of the alternately progressive and regressive motion;

d. conducting a single repetition of the alternately progressive and regressive motion at the adjusted amount of alternating current; and e. discharging the metal product from the plurality of induction coils.

16. A method as recited in claim 1, wherein the metal product has a weight of over 10 tons.

17. A method as recited in claim 1, wherein the metal product has a weight of over 25 tons.

18. A method for heating a metal product, comprising:

a. providing a plurality of rollers on which to transport the metal product;

b. providing a plurality of discrete induction coils energized with alternating electrical current with which to heat the metal product to a selected temperature as the metal product is transported through the plurality of induction coils on the plurality of rollers, each induction coil of the plurality of induction coils being separated from others of the plurality of induction coils by at least one of the plurality of rollers;

c. passing the metal product on the plurality of rollers through the plurality of induction coils with an alternately progressive and regressive motion so as to increase the temperature of the metal product;

d. receiving an instruction to discharge the metal product;

e. sensing the temperature of the metal product;

f. adjusting the amount of the alternating current supplied to the plurality of induction coils in order to heat the metal product to a target temperature within a selected number of the alternately progressive and regressive motion;

g. conducting the selected number of repetitions of the alternately progressive and regressive motion at the adjusted amount of alternating current; and h. discharging the metal product from the plurality of induction coils.

19. A method as recited in claim 18, wherein each of the plurality of induction coils is comprised of a plurality of windings, is energized by a separate power supply, and is spaced apart from others of the plurality of induction coils by a distance of at least about one foot.

20. A method as recited in claim 19, wherein the metal product comprises a first metal slab, and wherein the method further comprises passing a second metal slab through the plurality of induction coils on the plurality of rollers concurrently with passing the first metal slab through the plurality of induction coils, a head portion of the second metal slab being passed through the plurality of induction coils adjacent to a tail portion of the first metal slab.

21. A method as recited in claim 18, wherein the metal product comprises a first metal slab, and wherein the method further comprises passing a second metal slab through the plurality of induction coils on the plurality of rollers side by side with the first metal slab.

22. A method as recited in claim 21, wherein each of the plurality of rollers comprises two sections, each section being capable of moving independently of the other section.

23. A method as recited in claim 22, further comprising loading the first metal slab onto a first section and loading the second metal slab onto a second section and discharging one of the first and second metal slabs prior to discharging the other of the first and second metal slabs.

24. A method as recited in claim 18, wherein the alternately progressive and regressive motion comprises a plurality of repetitions, each repetition moving the metal product a distance substantially corresponding to a distance separating the induction coils from each other.

25. A method as recited in claim 24, further comprising automatically determining with a logic device the amount of power to be supplied to the plurality of induction coils in response to a set of predetermined parameters.

26. A method as recited in claim 25, further comprising, automatically determining with a logic device a number of repetitions of the alternately progressive and regressive motion to be conducted and the speed with which each repetition is conducted in response to a set of predetermined parameters.

27. A method as recited in claim 25, wherein the plurality of induction coils comprises an initial induction coil, a final induction coil, and at least one middle induction coil, and further comprising continuously supplying differing amounts of power through at least one of the initial and final induction coils, the amount of power supplied to the at least one of the initial and final induction coils being determined separately from the amount of power supplied to the at least one middle induction coil.

28. A method as recited in claim 24, further comprising:

a. sensing the arrival of the temperature of the metal product at a target temperature; and b. adjusting the amount of the alternating current supplied to the plurality of induction coils in order to maintain the metal product within a specified temperature range from the target temperature.

29. A method as recited in claim 24, wherein the metal product has a weight of over 10 tons.

30. A method for heating a metal product, comprising:

a. providing a plurality of rollers on which to transport the metal product;

b. providing a plurality of discrete induction coils energized with alternating electrical current with which to heat the metal product to a selected temperature as the metal product is transported through the plurality of induction coils on the plurality of rollers, each induction coil of the plurality of induction coils comprising a plurality of windings and being energized by a separate power supply, each induction coil of the plurality of induction coils also being discretely spaced apart from others of the plurality of induction coils by a distance of at least about one foot and being separated from others of the plurality of induction coils by at least one of the plurality of rollers, the plurality of induction coils comprising an initial induction coil, a final induction coil, and at least one middle induction coil;

c. passing the metal product on the plurality of rollers through the plurality of induction coils with a motion comprised of a plurality of alternatingly progressive and regressive repetitions, each of the plurality of alternatingly progressive and regressive repetitions moving the metal product a distance of at least six inches in one direction;

d. automatically determining with a logic device the amount of power to be supplied to the plurality of induction coils, the number of alternatingly progressive and regressive repetitions to be conducted, and the speed with which to conduct each of the alternatingly progressive and regressive repetitions; and e. metering the amount of power supplied to at least one of the initial and final induction coils with the logic device separately from the at least one middle induction coil and responsive to the proximity of the metal product to the at least one of the initial and final induction coils;

f. sensing the arrival of the temperature of the metal product at a target temperature; and g. adjusting the amount of alternating current supplied to the plurality of induction coils in order to maintain the metal product within a specified temperature range from the target temperature.

31. A method as recited in claim 30, wherein the metal product comprises a first steel slab, and further comprising passing a second steel slab through the plurality of induction coils on the plurality of rollers concurrently with passing the first steel slab through the plurality of induction coils, a head portion of the second steel slab being passed through the plurality of induction coils adjacent to a tail portion of the first steel slab.

32. A method as recited in claim 30, wherein the metal product comprises a first steel slab, and wherein the method further comprises passing a second steel slab concurrently through the plurality of induction coils on the plurality of rollers side by side with the first steel slab.

33. A method as recited in claim 32, wherein each of the plurality of rollers comprises two sections, each section being capable of moving independently of the other section.

34. A system for heating a metal product, comprising:

a. a plurality of horizontally oriented rollers on which to transport the metal product;

b. a plurality of induction coils energized with alternating electrical current with which to heat the metal product to a selected temperature as the metal product is transported through the plurality of induction coils on the plurality of rollers; and c. a logic device which causes the metal product to be passed on the plurality of rollers through the plurality of induction coils with an alternately progressive and regressive motion so as to increase the temperature of the metal product and which adjusts the amount of the alternating current supplied to the plurality of induction coils once the metal product attains a selected temperature in order to maintain the metal product within a specified temperature range from the selected temperature.

35. An apparatus for heating a plurality of metal products concurrently, comprising:

a. a plurality of horizontally oriented rollers on which to transport the metal products, each of the rollers being split into two or more sections, each section being capable of moving independently of the other sections;

b. a plurality of induction coils energized with alternating electrical current with which to heat the metal products to a selected temperature as the metal products are transported through the plurality of induction coils on the plurality of rollers;

c. a motor connected to at least one of the plurality of horizontally oriented rollers, the motor having a forward and a reverse motion so as to be capable of passing the metal products on the plurality of rollers through the plurality of induction coils with an alternately progressive and regressive motion and thereby increase the temperature of the metal product; and d. a logic device which adjusts the amount of the alternating current supplied to the plurality of induction coils at the earliest that one of the metal products attains a selected temperature in order to maintain said one of the metal products within a specified temperature range from the selected temperature.

* * * * *